United States Patent [19]

Winden

[11] 4,438,484

[45] Mar. 20, 1984

[54] LIGHTING BOLLARD FOR USE IN AN URBAN ENVIRONMENT

[75] Inventor: Joseph Winden, Grand Rapids, Mich.

[73] Assignee: Urban Systems Streetscape, Inc., Grand Rapids, Mich.

[21] Appl. No.: 420,009

[22] Filed: Sep. 20, 1982

[51] Int. Cl.[3] ..... F21V 29/00

[52] U.S. Cl. ..... 362/267; 362/145; 362/153; 362/307; 362/308; 362/311; 362/363; 362/367; 362/368; 362/374; 362/375; 362/376; 362/390; 362/431

[58] Field of Search ..... 362/145, 153, 267, 311, 362/363, 367, 368, 374, 375, 376, 390, 307, 308, 431

[56] References Cited

U.S. PATENT DOCUMENTS 4,104,711 8/1978 Carter ..... 362/390

4,242,726 12/1980 Steadman ..... 362/418

*Primary Examiner*—Stephen J. Lechert, Jr.

*Attorney, Agent, or Firm*—Price, Heneveld, Huizenga & Cooper

[57] ABSTRACT

A vandal resistant lighting bollard for use in an urban environment is provided comprising a steel base adapted for anchoring in an area requiring illumination and a steel housing received in an upright fashion on the base. One or more windows are disposed in the steel housing, the windows extending flush or parallel with the sides of the housing and the windows being formed from a tough, impact resistant, polycarbonate material. A source of illumination is disposed within the housing for projecting light through the window and an arrangement is provided for resiliently mounting the source of illumination within the housing to isolate the source of illumination from vibration and external impact.

31 Claims, 12 Drawing Figures

LIGHTING BOLLARD FOR USE IN AN URBAN ENVIRONMENT

BACKGROUND OF THE INVENTION

The invention relates generally to lighting fixtures and, more particularly, is directed to a lighting bollard that is resistant to vandalism, graffiti, natural hazards, deterioration due to long exposure to sunlight, salt spray, harsh chemicals or the like, and which is particularly adapted for use in a harsh, urban environment.

Lighting bollards and other low level ground mounted lighting structures of the type used to light pedestrian walkways are known in the prior art. While these prior art lighting bollards function satisfactorily when initially installed, these structures have proven relatively fragile and susceptible to damage in harsh urban environments. Such structures are often disfigured or damaged by vandals and are subject to deterioration due to natural hazards such as exposure to sunlight, salt spray and harsh chemicals. Damage from any one of a number of these mechanisms can destroy the function of the bollard and/or seriously mar its aesthetic appearance.

SUMMARY OF THE INVENTION

According to the present invention, these and other problems in the prior art are solved by provision of a vandal and weather resistant lighting bollard, which in one embodiment comprises a slipfitter steel base, which can be securely anchored near a walkway or the like requiring illumination, and a cylindrical steel housing received in an upright fashion on the slipfitter base. The slipfitter base comprises a cylindrical steel body having dimensions which correspond closely to the interior dimensions of the steel housing to provide a strong connection between the housing and the base that is resistant to breakage and/or distortion of the housing as a result of torsional loading on the bollard. One or more windows are disposed in the housing, the windows extending flush with the sides of the housing and the windows being formed from a tough impact resistant polycarbonate material such as that commercially available from the General Electric Company and known by the trademark LEXAN. A source of illumination is disposed within the housing for projecting light through the windows. The source of illumination includes a refractor for directing the light generated downwardly through the windows and onto the walkway or other similar area being illuminated. The source of illumination, any associated ballast circuitry and the refractor are resiliently mounted within the housing to isolate these relatively fragile structures from external vibration and impact. In another embodiment of the invention, a source of illumination is resiliently mounted within a rectangular steel base and housing. The base is securely anchored to the ground and the housing is mounted thereatop. The polycarbonate window is mounted within the exterior surface thereof and extends colinearly with the interior surfaces of the housing. The window is formed with a preset that requires it to be compressed for insertion within the housing.

DESCRIPTION OF THE PREFERRED EMBODIMENTS

Figure 1:
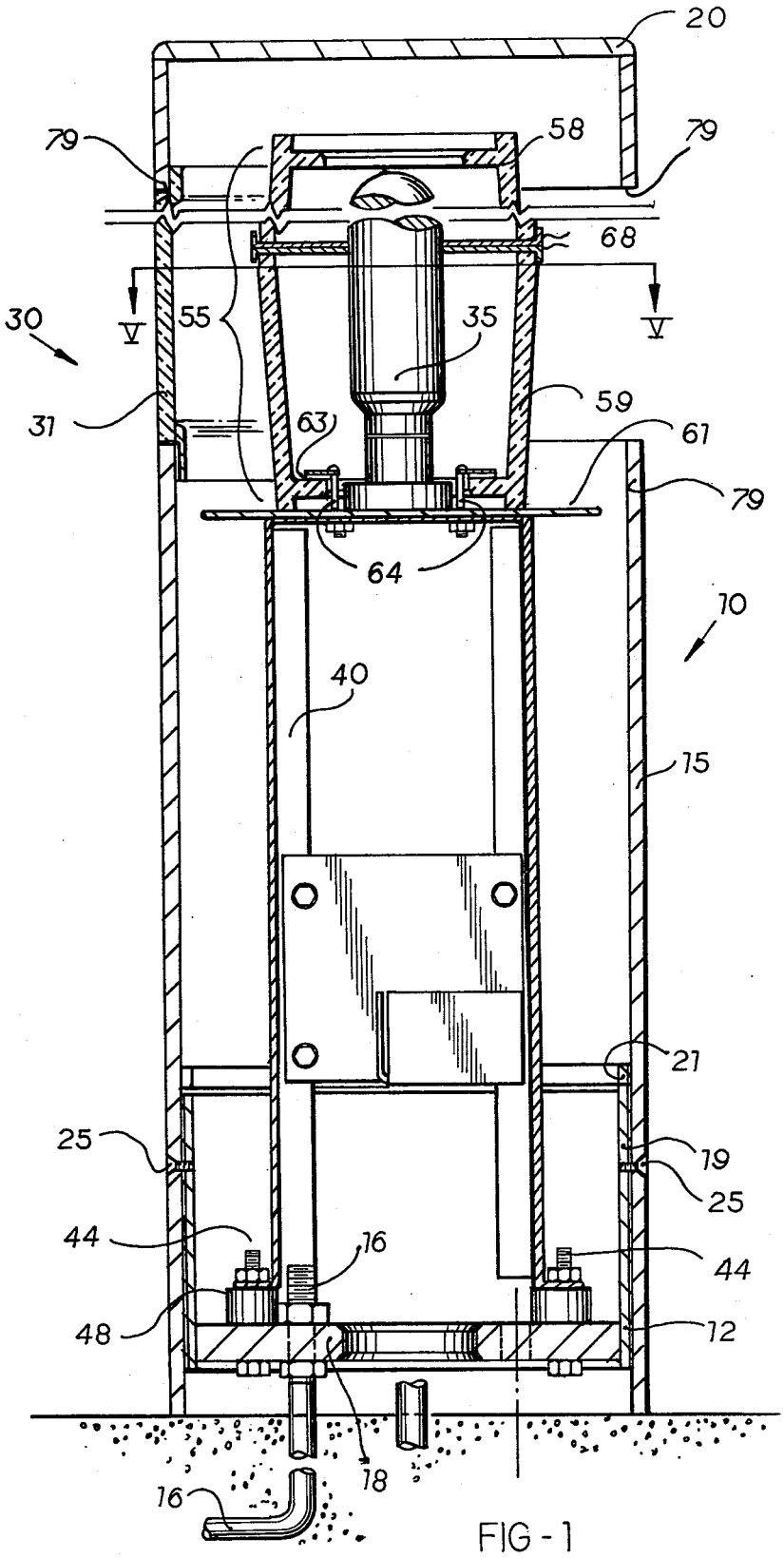
FIG. 1 is an elevational view, partially in section, of a light bollard constructed according to the present invention.
Figure 2:
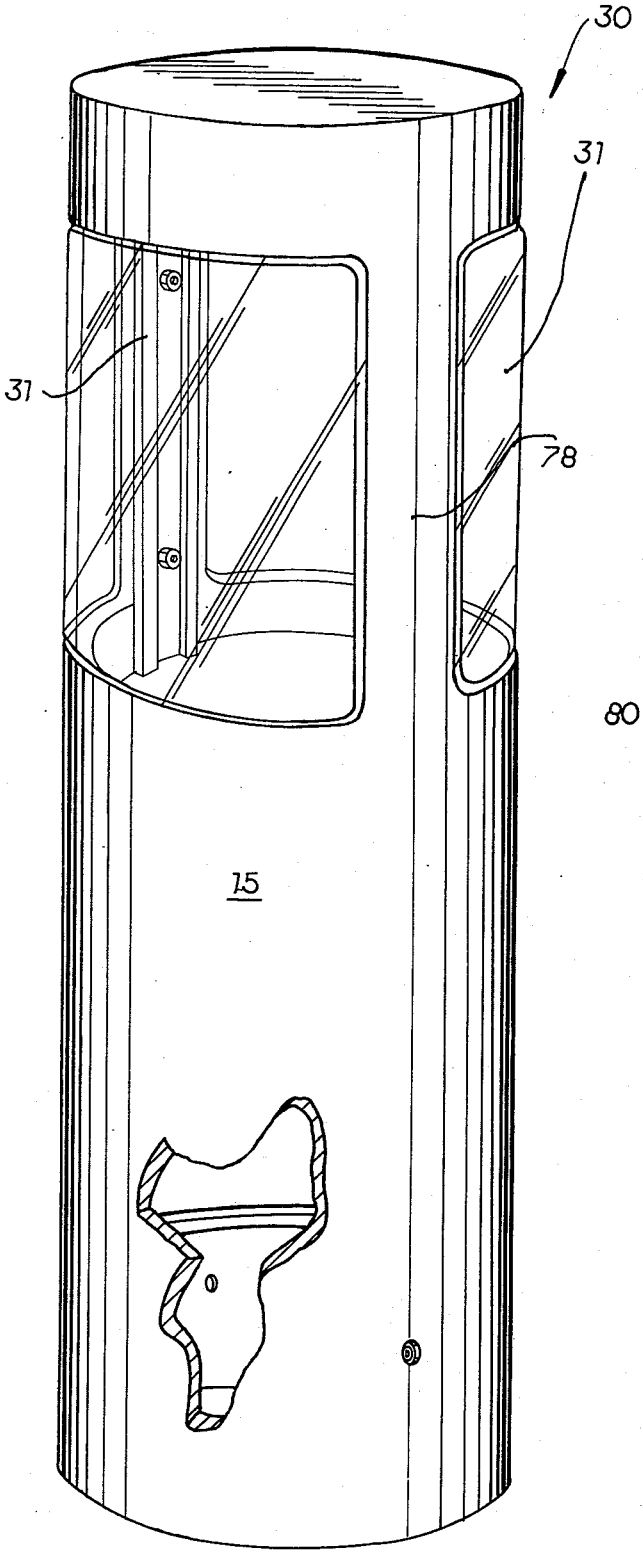
FIG. 2 is a perspective view of a housing forming a portion of the light bollard of the present invention.

With reference now to the Figures, and in particular with reference to FIG. 1, a lighting bollard constructed according to the present invention is generally illustrated at 10. The lighting bollard 10 comprises a slipfitter steel base 12 and a steel housing 15 also illustrated in FIGS. 2 and 4, respectively. The slipfitter steel base 12 is adapted for anchoring in an area requiring illumination with a plurality of anchor bolts 16 or the like, which are mounted in a poured concrete slab. The slipfitter steel base comprises a bolt ring 18 which is welded or otherwise suitably secured to a collar 19 which is provided with exterior dimensions that conform quite closely to the interior dimensions of the housing 15. The steel housing 15 is received in an upright fashion on the slipfitter base 12 and in this case, the housing 15 is formed from a length of relatively thick, seamless tubular steel ($\frac{1}{4}$ inch or greater) having a relatively flat top plate 20 welded thereto. In general, the top 20 is provided with a wall thickness approximately one third greater than the thickness of the housing 15. In this case, the collar 19 is cylindrical in shape and is provided with an outside diameter approximately equal to or slightly smaller than the inside diameter of the tubular steel from which the housing 15 is formed. A positioning ring 21, is welded or otherwise suitably secured to the interior of the housing 15, to accurately position the housing 15 relative to the slip fit collar 19 in the vertical direction through interference between the positioning ring 21 and the top of the collar 19 when the housing 15 is positioned thereover. A number of through bolts such as the flush mounted stainless steel bolts 25, illustrated in FIG. 1, may be used to secure the housing 15 to the slipfitter base 12. The positioning of the fasteners 25 is thus relatively unobtrusive to passing vandals, yet access to the interior of the housing is relatively simple for maintenance purposes. Furthermore, the orientation of the housing 15 relative to the base 12 can be readily altered by rotation of the housing relative to the base and alignment of the fasteners 25 with one of a plurality of mounting apertures provided in the base.

The bollard is provided with one or more windows generally indicated by the numeral 30. The windows include a lens element which is flush mounted with respect to the exterior of the housing 15, the lens element being separately illustrated in FIG. 3. Preferably the lens element 31 is formed from a tough impact resistant clear polycarbonate material such as that available from the General Electric Company and known by the trademark LEXAN. A source of illumination is disposed within the housing 15 such as a low pressure sodium lamp 35. However, mercury vapor, high pressure sodium and incandescent light sources may be provided. The lamp 35 is positioned proximate the windows 30 such that the lamp 35 projects light therethrough. A mounting arrangement is provided for the lamp 35 which effectively vibration isolates it from the slipfitter base 12 and the housing 15 to protect the relatively fragile lamp and its support structure from external vibration and/or impact.

Figure 4:
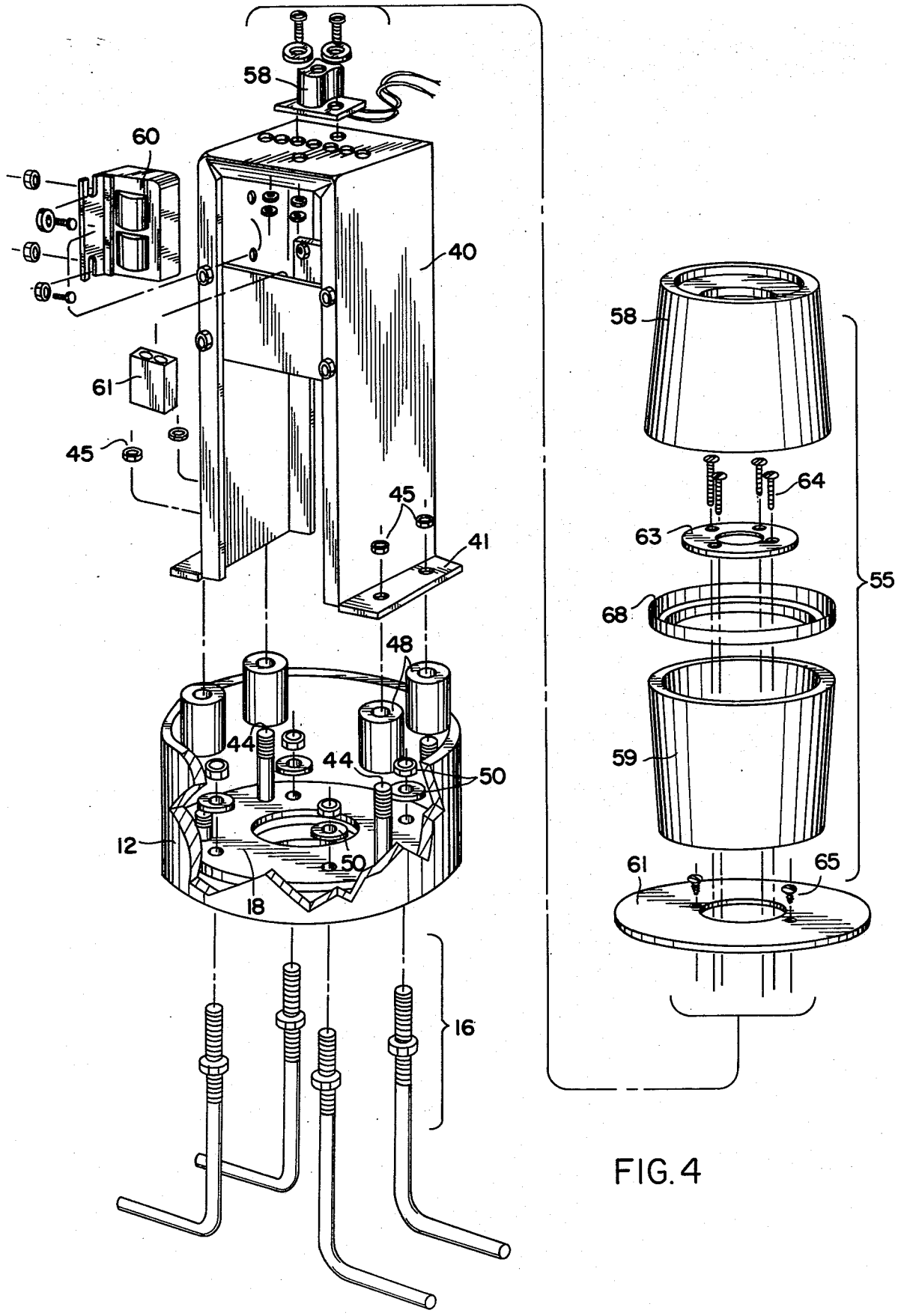
FIG. 4 is an exploded assembly of a slipfitter base and light source assembly forming a portion of the light bollard of the present invention.

With particular reference now to FIGS. 1 and 4, it is illustrated that the light source further comprises an aluminum frame 40 having a mounting flange 41 disposed on the bottom thereof. The mounting flange 41 is apertured for receiving the upstanding ends of bolts 44 which project upwardly through the bolt ring 18 of the slipfitter base 12. A plurality of elastomer stand-offs 48 are disposed over the upwardly directed ends 44 of bolts 44. The elastomer stand-offs may comprise, for example, cylindrical bushings made from a suitable vibration isolating elastomer. The mounting flange 41 of the aluminum frame 40 is then fastened to the top of the upstanding ends of the bolts 44 with a plurality of nuts and washers 45 such that the elastomer stand-offs 48 are compressed between the mounting flange 41 and the bolt ring 18 of the slipfitter flange 12. This effectively vibration isolates the aluminum frame 40 and all components mounted thereon which may, for example, include a light refractor assembly 55, lamp socket 58, and a lamp ballast circuit including ballast coil 60 and capacitor 61. These components can be secured to the aluminum frame 40 in any suitable fashion with the confidence that these components will be protected from external vibration and impact by the vibration isolated frame 40.

The light refractor assembly 55 comprises first and second glass refractor elements 58 and 59 of generally cylindrical configuration. Although two elements are shown here, it should be understood that a single cylindrical refractor element may be used. The cylindrical glass elements 58 and 59 are formed from a borosilicate glass and include a plurality of facets which direct light downwardly through the windows 30 in a prismatic fashion. A reflector plate 61 is disposed below the lamp 35 and the lowermost cylindrical refractor 59 is secured atop the aluminum frame 40 with a clamping ring 63 and a plurality of bolts 64 which bolt through the top of the aluminum frame 40. Fasteners 65 may be used in addition to the clamping force provided by the bolts 64 to secure the reflector plate 61 under the refractor element 59. A pair of spun aluminum rings 68 are disposed over the edges of the cylindrical refractor elements 58 and 59 and the rings 68 are secured with epoxy both to the edges of the refractor elements and themselves to retain the cylindrical refractor element assembly together.

Figure 3:
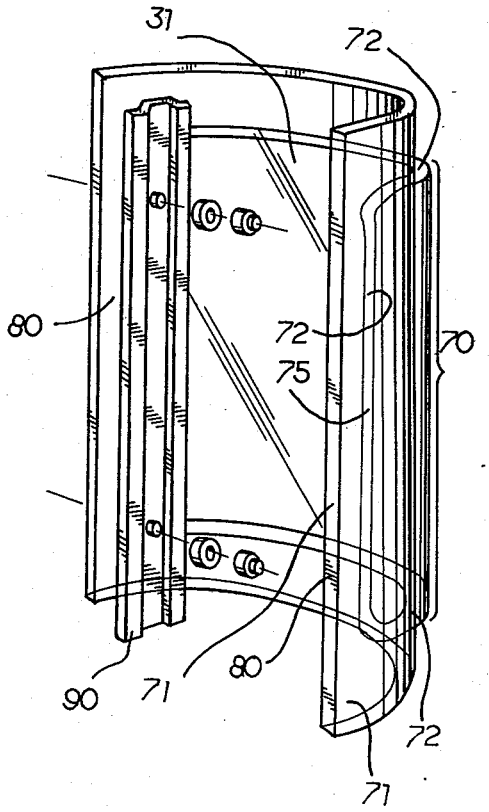
FIG. 3 is a perspective view of a lens structure used in the light bollard of the present invention.
Figure 5:
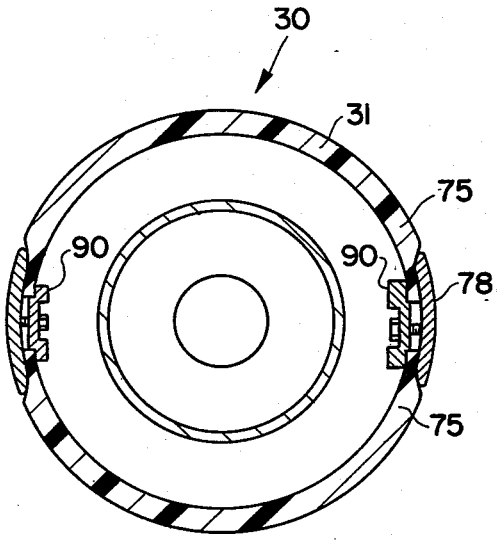
FIG. 5 is a sectional view of the light bollard illustrated in FIG. 1 taken along V—V in FIG. 1.

As best illustrated in FIG. 3, the cylindrical lens which is mounted within the windows 30 comprises a cylindrical body portion 70, a peripheral flange 71 and a transition portion 72 disposed therebetween. The cylindrical body portion 70 of the lens 31 is provided with a radius that is approximately equal to the radius of the exterior diameter of the cylindrical housing 15. The peripheral flange 71 is provided with a radius that is approximately equal to the radius of the interior diameter of the cylindrical housing 15. The transition portion 72 is provided with a radius or radii that are in general somewhat smaller than the radii of the cylindrical body 70 and the peripheral flanges 71. However, with reference now also to FIG. 5, it is illustrated that with regard to the vertically oriented transitions 75 of the lens 31, the radii of the vertically oriented transition portions 75 decrease relatively slowly, and almost tangentially, from a value approximately equal to the radius of the exterior of the cylindrical housing 15 to reduce stress concentrations in the lens 31 adjacent its mounting point. The vertical edges of the windows 30 disposed in the housing 15, that is the vertical edges of the upstanding post 78 in the housing 15, are also provided with a shape that is roughly tangential to the exterior shape of the cylindrical housing 15. As best illustrated in FIG. 1, the horizontally extending edges 79 of the windows 30 are provided with edges that extend generally perpendicularly to the cylindrical housing 15, and the horizontal portions 81 of the transitions are provided with more uniform smaller radii. Stress concentrations in the lens 31 are of less concern here since they are farther from the mounting point of the lens. The vertical portions 80 of the peripheral flange 71 are engaged by a metal retaining bracket 90 which is bolted or otherwise suitably secured to the interior of the cylindrical housing 15. The elongate bracket 90 securely clamps the long, relatively flat vertical portions 80 of the lenses 31 between the interior surface of the cylindrical housing 15 and the flanges of the elongate bracket 90 to securely clamp the lens 31 in place. The relatively tough impact resistant nature of the polycarbonate material from which the lens 31 is formed and the stress relieved configuration of the lens structure adjacent the mounting bracket 90 renders the lens substantially impervious to damage from a wide variety of missiles, including for example, small caliber bullets. Preferably a pair of such windows are provided on opposing sides of the cylindrical housing 15. The lenses 31 are manufactured from $\frac{3}{8}$ inch LEXAN in a vacuum assisted thermoforming process.

Figure 6:
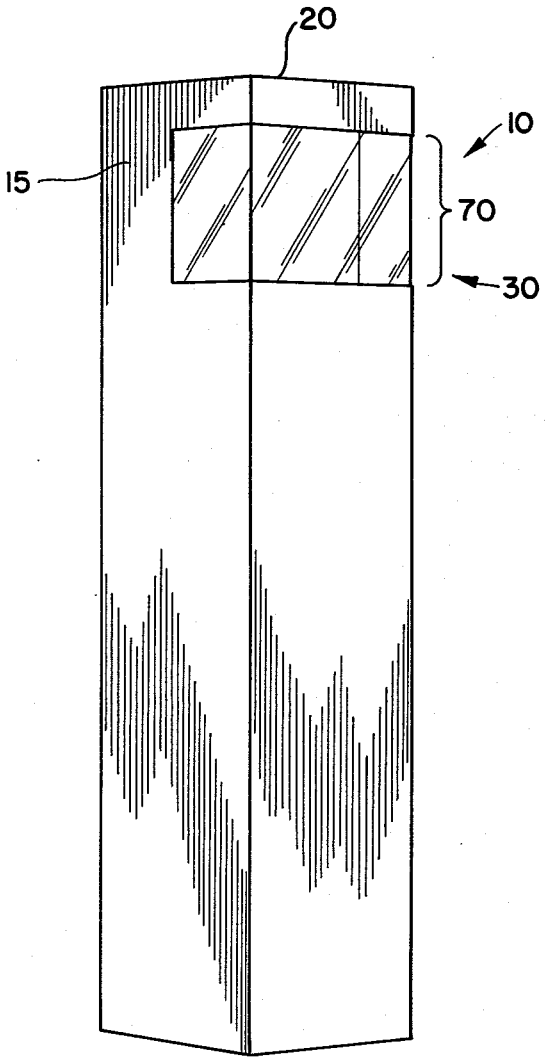
FIG. 6 is a perspective view of another embodiment of the light bollard of the present invention.
Figure 7:
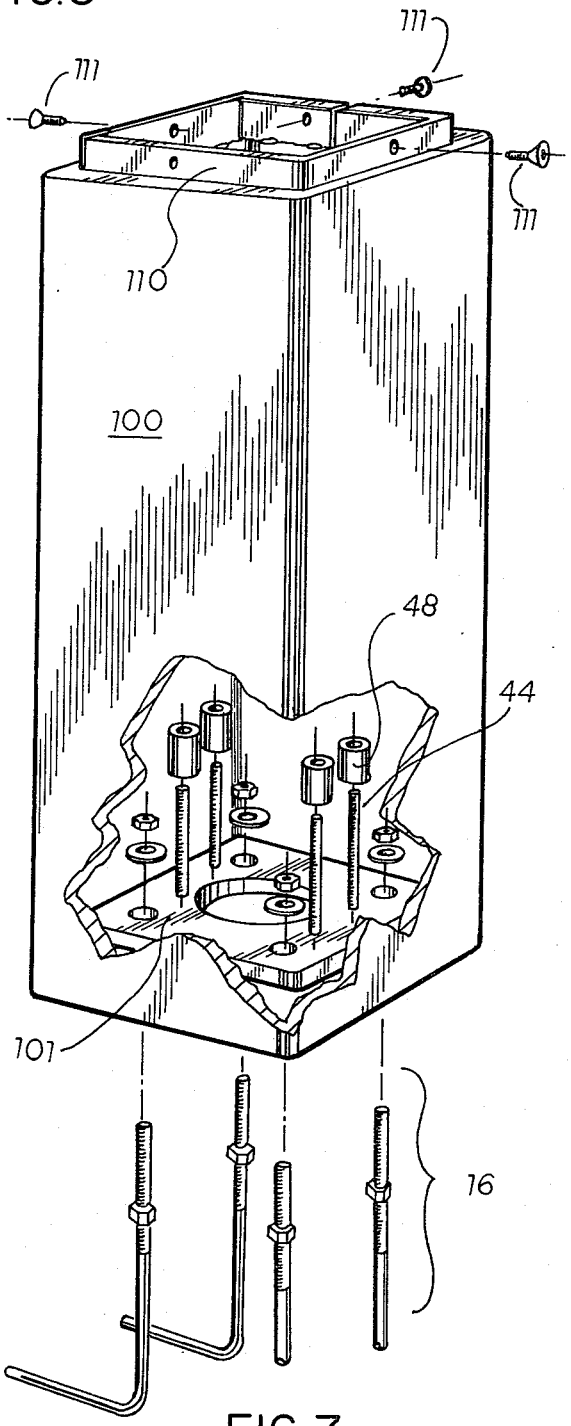
FIG. 7 is an exploded assembly of the base of the embodiment of the invention illustrated in FIG. 6.

As best illustrated in FIG. 6, in some embodiments of the invention, the housing 15 may be formed from a length of rectangular steel tubing ($\frac{1}{4}$ inch thickness or greater) having a relatively flat top plate 20 (approximately $\frac{1}{3}$ larger wall thickness) welded to the top thereof with one or more window structures 30 disposed in the sides thereof. The construction of the rectangular bollard illustrated in FIG. 6 can be similar to the construction of the cylindrical bollard heretofore described with the exception that the slipfitter flange 19, not illustrated in FIG. 6, which engages the interior surface of the rectangular housing 15 would have to be provided with a rectangular shape that closely corresponds to the interior shape of the rectangular housing 15. Also, similarly, the lens 31 which is disposed in the sides of the housing 15 is provided with a central body portion 70 that is generally rectangular, rather than cylindrical, in shape and which correspond to the exterior dimensions of the rectangular housing 15. However, with reference now to FIGS. 7–12, it is illustrated that in preferred embodiments of the rectangular bollard of FIG. 6, the slipfitter base may be replaced with a base 100, illustrated in FIG. 7, that includes a bolt ring 101 secured to a mounting surface with anchor bolts 16.

Figure 10:
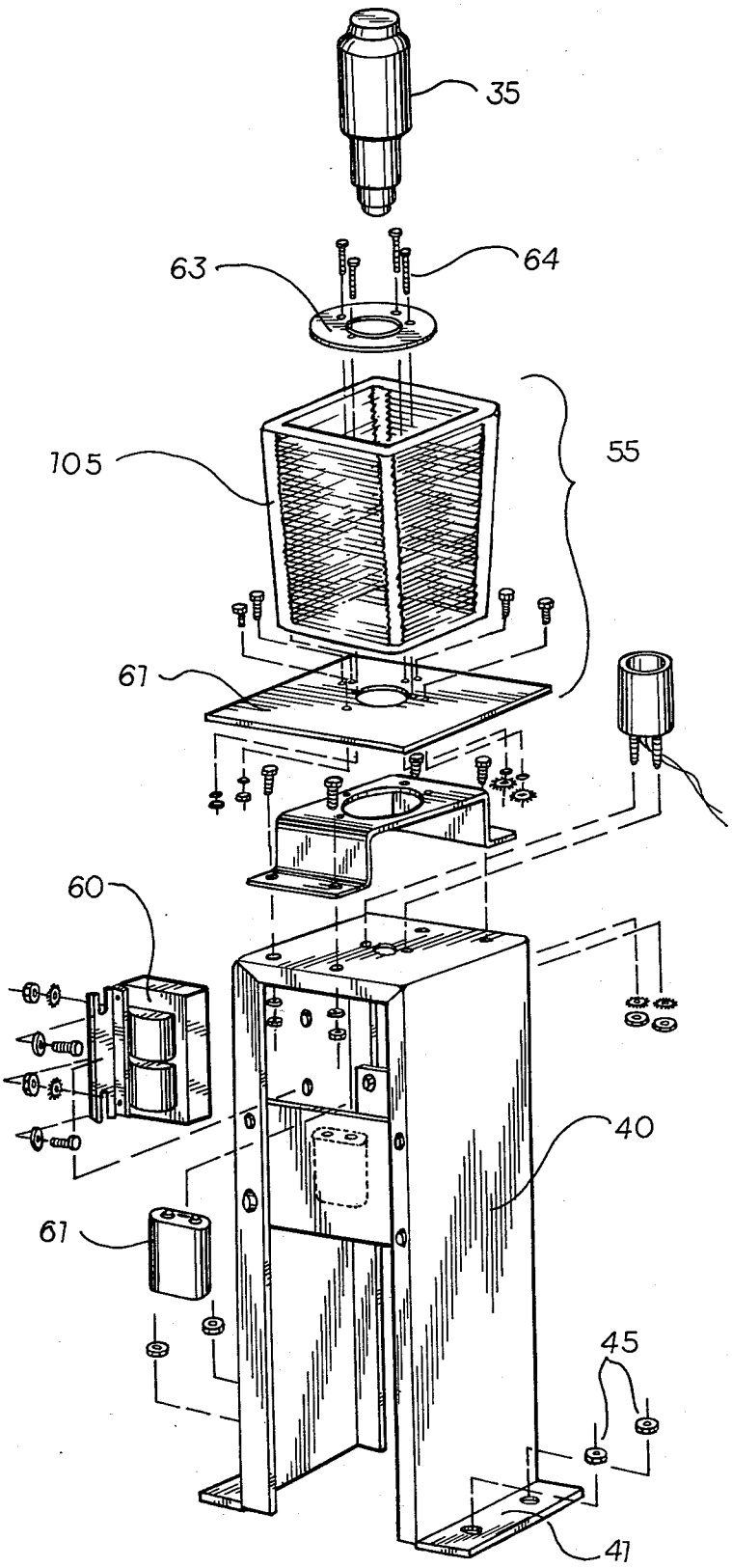
FIG. 10 is an exploded assembly of the light source and resilient mounting structure therefor illustrated in FIG. 6.

With reference now also to FIG. 10, it is illustrated that the construction of aluminum frame 40 is similar to previous embodiments and a lamp 35 and refractor assembly 55 are similarly mounted thereatop. However, in this case the refractor 105 preferably comprises a single piece construction having a rectangular cross section. Apertured flange 41 of the aluminum frame 40 is similarly mounted with bolts 44 and elastomer standoffs 48 within the base 100 and housing 15, so that the frame 40 and all components mounted thereon are effectively vibration isolated.

Figure 8:
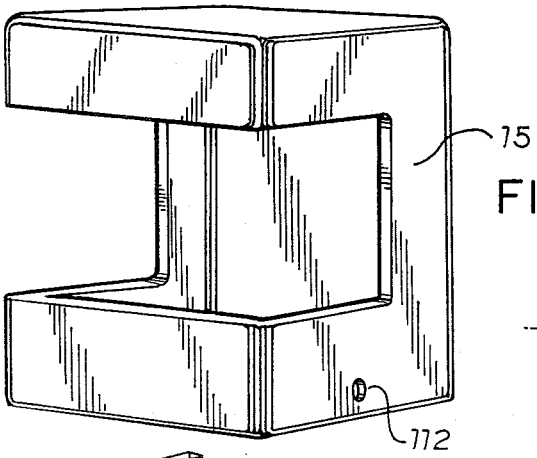
FIG. 8 is a perspective view of the housing of the embodiment of the invention illustrated in FIG. 6.

With reference now alos to FIG. 8, it is illustrated that the housing 15 is preferably square in shape and is secured to apertured flange 110 of the base 100 with a plurality of through fasteners 111. If the base 100 and housing 15 are provided with square cross sections, the orientation of the housing 15 relative to the base 100 can be easily varied in 90° increments by rotating the housing 15 relative to the base 100 until another set of apertures in the flange 110 align with the mounting apertures 112 in the housing 15.

Figure 9:
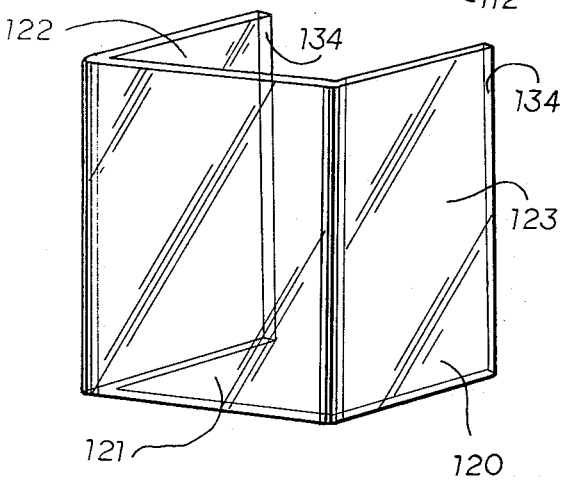
FIG. 9 is a perspective view of the window of the embodiment of the invention illustrated in FIG. 6.
Figure 11:
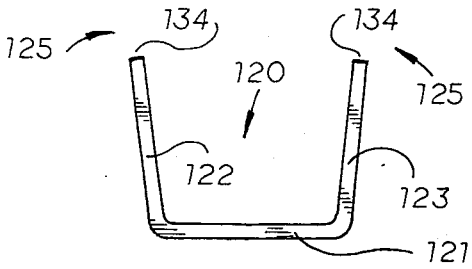
FIG. 11 is a top view of the window illustrated in FIG. 9.
Figure 12:
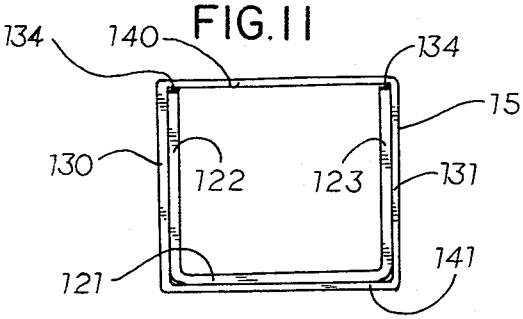
FIG. 12 is a bottom view of the housing of the embodiment of the invention illustrated in FIG. 8 with the window illustrated in FIGS. 9 and 11 inserted therein.

With reference now also to FIGS. 9, 11 and 12, it is illustrated that a rectangular window 120 is provided that is inserted within the housing 15. As best illustrated in FIG. 11, the window 120 comprises a front portion 121 and first and second side portions 122 and 123, depending from opposite ends thereof. The window 120 is thermo formed from $\frac{3}{8}$ inch LEXAN with a preset that requires compression of the side portions 122 and 123 inwardly in the direction of the arrows 125 before the lens 120 can be inserted within the housing 15. This preloads the side portions 122 and 123 of the window 120 against the interior surfaces of the housing sides 130 and 131, respectively. The edges 134 of the side portions 122 and 123 abut the sidewall 140 of housing 15 to preload the front 121 of the window against the interior surface of the sidewall 141 of housing 15. In addition to the lens preload against the interior of the housing, a silicone gasket material is used to adhesively secure the window within the housing. The window 120 is thermoformed from $\frac{3}{8}$ inch LEXAN. This construction results in a window that is virtually immume to vandalism.

The exterior of the bollards is coated with a polyamide epoxy primer and an aliphatic polyurethane coating which is impervious to scratches and graffiti. The interior surfaces of the housing and other ferromagnetic structures such as the slipfitter base are also coated with a suitable corrosion inhibiting coating. The aluminum frame upon which the lighting assembly rests is impervious to most forms of corrosion and the peripheral flange which surrounds the body of the lens is gasketed to the interior of the housing of the bollard with a silicone sealer which renders the housing waterproof and bugproof.

The above description should be considered exemplary and that of the preferred embodiment only. Modifications of the invention will occur to those who make and use the invention. It is desired to include within the scope of the present invention all such modifications that come within the proper scope of the appended claims. The true scope and spirit of the present invention is to be determined with reference to the appended claims.

The embodiments of the invention in which an exclusive property or privilege is claimed are defined as follows:

1. A vandal resistant, low elevation lighting bollard for providing indirect lighting in an urban environment comprising:

a slipfitter steel base adapted for anchoring in an area requiring illumination, said slipfitter steel base comprising a steel base plate with means for anchoring connected thereto and an upstanding steel support flange welded thereto;

a welded one-piece steel housing, said housing being received on said slipfitter base, said upstanding support flange having exterior dimensions smaller than the interior dimensions of said housing whereby said support flange is slidably received in said housing;

means for fastening said housing to said slipfitter base;

a one-piece window disposed below eye level in said housing, said window extending flush with a side of said housing and said window being formed from a tough impact resistant polycarbonate material.

2. The vandal resistant bollard of claim 1 wherein said housing is constructed from a length of tubular steel having a wall thickness of at least $\frac{1}{4}$ inch with a relatively flat top plate welded thereto having a wall thickness approximately $\frac{1}{3}$ inch greater than the wall thickness of said housing.

3. The vandal resistant bollard of claim 1 wherein said housing is formed from cylindrical tubing and is provided with a shape approximating a right circular cylinder.

4. The vandal resistant bollard of claim 1 wherein said housing is formed from rectangular tubing and is provided with a generally rectangular shape.

5. The vandal resistant bollard of claim 3 wherein said window further comprises a cylindrical lens having a peripheral flange and a transition disposed therebetween.

6. The vandal resistant bollard of claim 5 wherein said cylindrical lens is provided with a radius approximately equal to the radius of said cylindrical housing.

7. The vandal resistant bollard of claim 6 wherein at least some portion of said transition is provided with a radius that decreases slowly from a value approximately equal to the radius of said cylindrical housing at the point at which said transition meets said cylindrical lens.

8. The vandal resistant bollard of claim 7 wherein at least a portion of said peripheral flange extends parallel to the interior surface of said cylindrical housing and a lens retainer is provided for clamping said portion of said peripheral flange that extends parallel to the interior of said cylindrical housing.

9. The vandal resistant bollard of claim 8 wherein said window is provided with two vertical edges and two horizontal edges, said vertical edges being provided with surfaces that extend tangentially with respect to said cylindrical housing and said horizontal edges being provided with surfaces that extend perpendicularly with respect to said cylindrical housing.

10. The vandal resistant bollard of claim 5 wherein said peripheral flange is gasketed to the interior of said housing with a silicone sealer.

11. The vandal resistant bollard of claim 1 wherein a pair of said windows are provided disposed on opposing sides of said housing.

12. The vandal resistant bollard of claim 1 wherein said slipfitter base includes a plurality of upright standing bolts and said means for resiliently mounting said source of illumination comprises a plurality of elastomer stand-offs surrounding said bolts, said light source including a mounting flange which is fastened to said bolts and clamped against said elastomer stand-offs.

13. The vandal resistant bollard of claim 12 wherein said light source further comprises an aluminum vibration isolated frame assembly, said mounting flange being disposed proximate the bottom of said frame assembly.

14. The vandal resistant bollard of claim 13 wherein said light source further comprises a lamp mounted atop said frame assembly and a generally cylindrical glass light refractor surrounding said lamp, said glass light refractor including facets for downwardly directing the light generated by said lamp.

15. The vandal resistant bollard of claim 1 wherein said window is thermo formed from $\frac{3}{8}$ inch thick LEXAN.

16. The vandal resistant bollard of claim 1 wherein said slipfitter base comprises a body bolted to a support surface, said body extending parallel to and in close fitting relationship to the interior diameter of said housing, and means for fastening said housing to said body when said body is inserted therein.

17. The vandal resistant bollard of claim 16 wherein said means for fastening said housing to said body comprises a plurality of stainless steel countersunk through bolts.

18. The vandal resistant bollard of claim 1 wherein said housing is coated with a polyamide epoxy primer and an aliphatic polyurethane coating.

19. A vandal resistant low elevation lighting bollard for providing indirect lighting in an urban environment comprising:

a steel base adapted for anchoring in an area requiring illumination, said base comprising a steel base plate with means for anchoring connected thereto and an upstanding welded one-piece steel base structure having a slipfitter disposed thereatop, said slipfitter comprising an upstanding flange;

a welded one-piece steel housing, said housing being received atop said base said upstanding flange of said slipfitter having exterior dimensions smaller than the interior dimensions of said housing, whereby said slipfitter flange is slidably received in said housing;

means for fastening said housing to said slipfitter flange;

a one-piece window disposed in said housing, said window extending parallel with a side of said housing and said window being formed from a tough impact resistant polycarbonate material;

a source of illumination disposed within said housing for projecting light through said window; and means for resiliently mounting said source of illumination within said housing to isolate said source of illumination from external impact.

20. The vandal resistant lighting bollard of claim 19 wherein said housing is rectangular and said window extends parallel to three sides of said rectangular housing.

21. The vandal resistant lighting bollard of claim 20 wherein said window is disposed within said rectangular housing and the exterior surface thereof extends colinearly with the interior surfaces of the sides of said housing.

22. The vandal resistant lighting bollard of claim 21 wherein said window is preformed with a set that requires said window to be compressed before insertion in said housing.

23. The vandal resistant lighting bollard of claim 22 wherein said window comprises a front portion and first and second side portions depending from opposite ends thereof, said window being provided with a preset that requires compression of said side portions together prior to insertion of said window in said housing.

24. The vandal resistant lighting bollard of claim 23 wherein said front portion of said window and said first and second side portions of said window extend parallel to first, second and third sides of said rectangular housing, respectively, the edges of said first and second side portions of said window abutting the fourth side of said rectangular housing for compressing said front of said window against said second side of said rectangular housing.

25. The vandal resistant lighting bollard of claim 24 wherein said front portion, said first side portion and said second side portion of said window are secured to the sides of said rectangular housing with a silicone gasket material.

26. The vandal resistant lighting bollard of claim 19 wherein said housing is formed from cylindrical tubing and is provided with a shape approximating a right circular cylinder.

27. The vandal resistant lighting bollard of claim 19 wherein said base includes a plurality of upright standing bolts and said means for resiliently mounting said source of illumination comprises a plurality of elastomer stand-offs surrounding said bolts, said light source including a mounting flange which is fastened to said bolts and clamped against said elastomer stand-offs.

28. The vandal resistant lighting bollard of claim 27 wherein said light source further comprises an aluminum vibration isolated frame assembly, said mounting flange being disposed proximate the bottom of said frame assembly.

29. The vandal resistant lighting bollard of claim 28 wherein said light source further comprises a lamp mounted atop said frame assembly and a generally rectangular glass light refractor surrounding said lamp, said glass light refractor including facets for downwardly directing the light generated by said lamp.

30. The vandal resistant lighting bollard of claim 19 wherein said window is thermoformed from $\frac{3}{8}$ inch thick LEXAN.

31. The vandal resistant lighting bollard of claim 19 wherein said housing is coated with a polyamide epoxy primer and an aliphatic polyurethane coating.

* * * * *